US009856758B2

(12) United States Patent
Son et al.

(10) Patent No.: US 9,856,758 B2
(45) **Date of Patent: *Jan. 2, 2018**

(54) CONTINUOUS VARIABLE VALVE TIMING APPARATUS AND ENGINE PROVIDED WITH THE SAME

(71) Applicant: Hyundai Motor Company, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 115 days.

This patent is subject to a terminal disclaimer.

(21) Appl. No.: 14/942,250

(22) Filed: Nov. 16, 2015

(65) Prior Publication Data

US 2017/0009612 A1 Jan. 12, 2017

(30) Foreign Application Priority Data

Jul. 7, 2015 (KR) ..... 10-2015-0096267

(51) Int. Cl.

| | |
|---|---|
| ***F01L 1/34*** | (2006.01) |
| ***F01L 1/344*** | (2006.01) |
| *F01L 13/00* | (2006.01) |

(52) U.S. Cl.

CPC ..... *F01L 1/344* (2013.01); *F01L 13/0047* (2013.01); *F01L 13/0036* (2013.01); *F01L 2013/0052* (2013.01)

(58) Field of Classification Search

CPC ... F01L 1/344; F01L 13/0036; F01L 13/0047; F01L 2013/0052

USPC ..... 123/90.15, 90.16, 90.17, 90.27, 90.31, 123/90.6

See application file for complete search history.

(56) References Cited

U.S. PATENT DOCUMENTS

| | | | | |
|---|---|---|---|---|
| 5,924,334 | A | 7/1999 | Hara et al. | |
| 8,813,704 | B2 * | 8/2014 | Kim | F01L 1/0532 123/90.16 |
| 9,512,748 | B2 | 12/2016 | Kim et al. | |

FOREIGN PATENT DOCUMENTS

| | | | |
|---|---|---|---|
| JP | 6-185321 | A | 7/1994 |
| JP | 9-41924 | A | 2/1997 |
| JP | 5582195 | B2 | 7/2014 |

* cited by examiner

*Primary Examiner* — Ching Chang
(74) *Attorney, Agent, or Firm* — Morgan, Lewis & Bockius LLP

(57) ABSTRACT

A continuously variable valve timing apparatus may include a camshaft, a first and a second cam portions of which two cams are formed thereto, of which the camshaft is inserted thereinto and of which relative phase angles with respect to the camshaft are variable, a first and a second inner brackets transmitting rotation of the camshaft to the first and second cam portions respectively, a first and a second slider housings of which the first and second inner brackets are rotatably inserted thereinto respectively and of which relative positions with respect to the camshaft are variable, a control shaft connected with the slider housings and a control portion connected with the control shaft and selectively changing the positions of the inner brackets.

18 Claims, 9 Drawing Sheets

CONTINUOUS VARIABLE VALVE TIMING APPARATUS AND ENGINE PROVIDED WITH THE SAME

CROSS-REFERENCE TO RELATED APPLICATION

The present application claims priority to and the benefit of Korean Patent Application No. 10-2015-0096267 filed on Jul. 7, 2015, the entire contents of which is incorporated herein for all purposes by this reference.

BACKGROUND OF THE INVENTION

Field of the Invention

The present invention relates to a continuously variable valve timing apparatus and an engine provided with the same. More particularly, the present invention relates to a continuously variable valve timing apparatus and an engine provided with the same which may vary opening timing of a valve according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directly providing a continuous variable valve timing apparatus and an engine provided with the same which may vary valve timing according to operation conditions of an engine, with a simple construction.

A continuously variable valve timing apparatus according to an exemplary embodiment of the present invention may include a camshaft, a first and a second cam portions of which two cams are formed thereto, of which the camshaft is inserted thereinto and of which relative phase angles with respect to the camshaft are variable, a first and a second inner brackets transmitting rotation of the camshaft to the first and second cam portions respectively, a first and a second slider housings of which the first and second inner brackets are rotatably inserted thereinto respectively and of which relative positions with respect to the camshaft are variable, a control shaft connected with the slider housings and a control portion connected with the control shaft and selectively changing the positions of the inner brackets.

The continuously variable valve timing apparatus may further include a rotation ring mounted to the camshaft and of which a ring key transmitting the rotation to the first cam portion and the second cam portion is formed respectively, and a cam key may be formed to the first and second cam portion respectively, and the rotation of the rotation ring may be transmitted to the first and second cam portions through the first and second inner brackets respectively.

The continuously variable valve timing apparatus may further include first pins of which a ring key slot, the each ring key is slidably inserted thereto, is formed thereto respectively and second pins of which a cam key slot, the each cam key is slidably inserted thereto, is formed thereto respectively, and wherein a first sliding pin hole and a second sliding pin hole, of which the first pin and the second pin are inserted thereto respectively, may be formed to the inner brackets.

The first pin and the second pin may be formed as a circular cylinder shape and the first sliding pin hole and the second sliding pin hole may be formed for the first pin and the second pin to be rotated within thereto.

Parts of the first sliding pin hole and the second sliding pin hole may be opened for movements of the ring key and the cam key not to be interrupted.

The continuously variable valve timing apparatus may further include a bearing inserted between the slider housing and the first and the second inner brackets.

A cam cap connecting portion may be formed between the two cams of the cam portions, wherein the continuously variable valve timing apparatus may further include a cam cap connected with a cylinder head, and wherein the cam cap connecting portion may be rotatably disposed between the cam cap and the cylinder head.

A guide hole may be formed to the each slider housing, and wherein a guide rod inserted into the guide hole may be connected with the cam cap in order to guide movements of the slider housings.

The control portion may include a ball screw housing connected with the control shaft, a ball screw engaged with the ball screw housing and a control motor selectively rotating the ball screw.

The continuously variable valve timing apparatus may further include a sensor unit detecting movements of the slider housings.

The sensor unit may include a rack gear mounted to the control shaft, a spur gear rotatably mounted to the slider housings and engaged with the rack gear, a sensor plate mounted to the spur gear and a sensor detecting rotation of the sensor plate.

An engine according to an exemplary embodiment of the present invention may include a camshaft, two first and second cam portions of which two cams are formed thereto respectively, of which the camshaft is inserted thereinto and of which relative phase angles with respect to the camshaft are variable, a rotation ring mounted to the camshaft and of which two ring keys are formed thereto, a first and a second inner brackets transmitting rotation of the ring keys to the first and second cam portions respectively, a first and a second slider housings of which the first and second inner brackets are rotatably inserted thereinto respectively and of which relative positions with respect to the camshaft are variable, a control shaft connected with the slider housings and a control portion connected with the control shaft and selectively changing the positions of the inner brackets.

The control portion may include a ball screw housing connected with the control shaft, a ball screw engaged with the ball screw housing and a control motor selectively rotating the ball screw.

The engine may further include first pins of which a ring key slot, the each ring key is slidably inserted thereto, is formed thereto respectively and second pins of which a cam key slot, the each cam key is slidably inserted thereto, is formed thereto respectively, and wherein a first sliding pin hole and a second sliding pin hole, of which the first pin and the second pin are inserted thereto respectively, may be formed to the inner brackets.

The engine may further include a bearing inserted between the slider housing and the first and the second inner brackets.

A cam cap connecting portion may be formed between the two cams of the cam portions, wherein the engine may further include a cam cap connected with a cylinder head, and wherein the cam cap connecting portion may be rotatably disposed between the cam cap and the cylinder head.

A guide hole may be formed to the each slider housing, and wherein a guide rod inserted into the guide hole may be connected with the cam cap in order to guide movements of the slider housings.

The engine may further include a rack gear mounted to the control shaft, a spur gear rotatably mounted to the slider housings and engaged with the rack gear, a sensor plate mounted to the spur gear and a sensor detecting rotation of the sensor plate.

As described above, a continuous variable valve timing apparatus according to an exemplary embodiment of the present invention may vary valve timing according to operation conditions of an engine, with a simple construction.

The continuous variable valve timing apparatus according to an exemplary embodiment of the present invention may be reduced in size and thus the entire height of a valve train may be reduced.

Since the continuous variable valve timing apparatus may be applied to an existing engine without excessive modification, thus productivity may be enhance and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
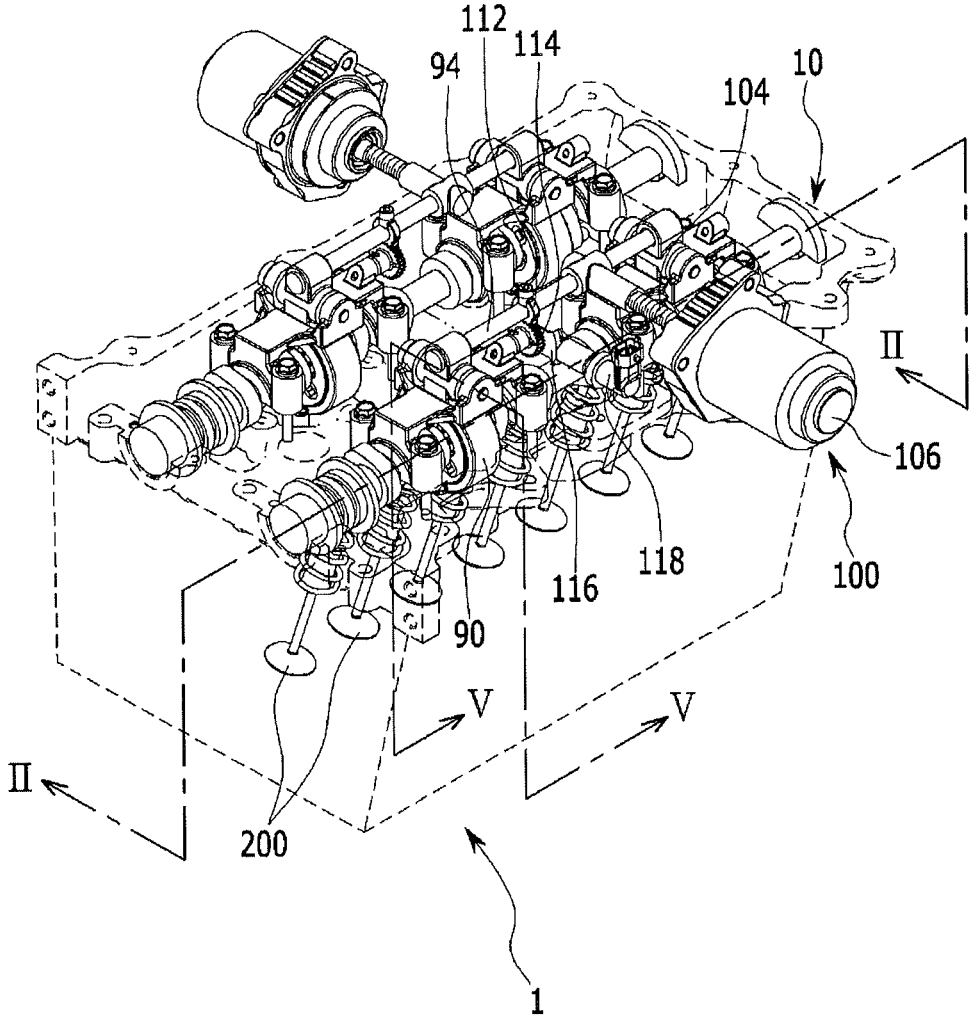
FIG. 1 is a perspective view of an engine provided with a continuous variable valve timing apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 2:
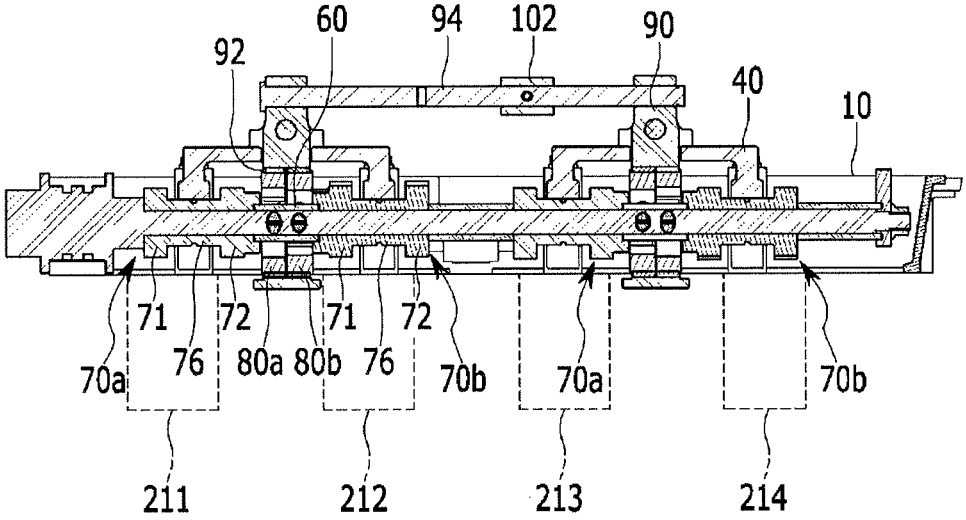
FIG. 2 is a cross-sectional view along a line II-II of FIG. 1.
Figure 3:
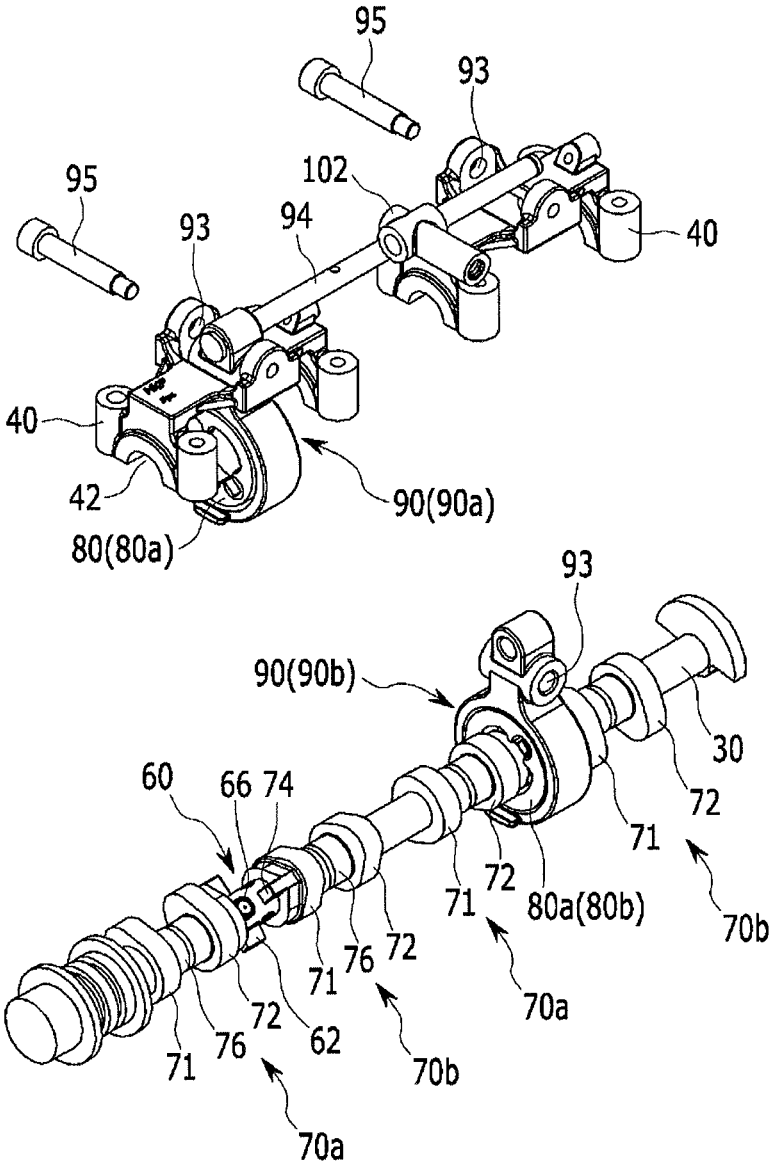
FIG. 3 and FIG. 4 are partial exploded perspective views of a continuous variable valve timing apparatus according to an exemplary embodiment of the present invention.
Figure 4:
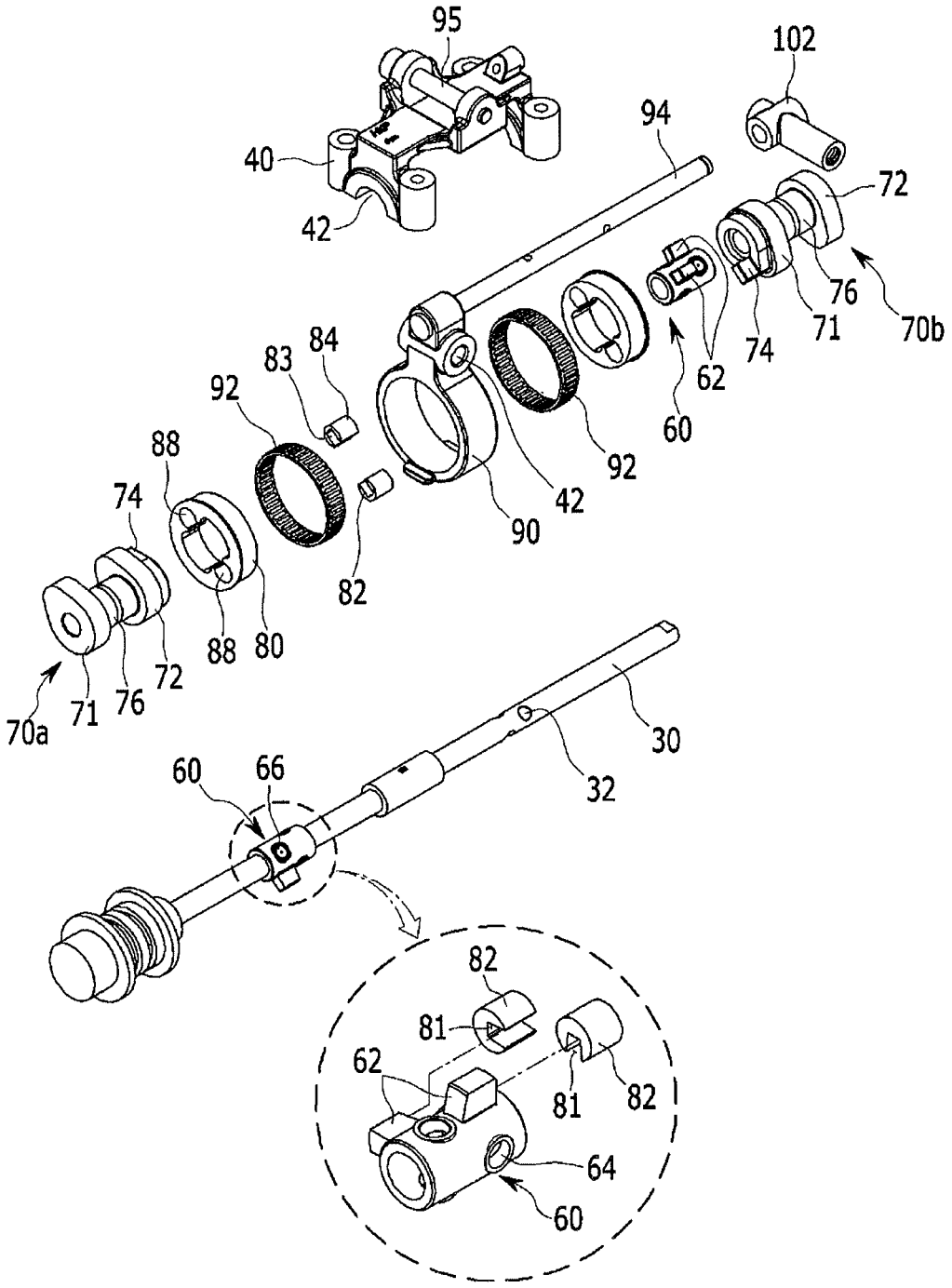

FIG. 1 is a perspective view of an engine provided with a continuous variable valve timing apparatus according to an exemplary embodiment of the present invention, FIG. 2 is a cross-sectional view along a line II-II of FIG. 1, and FIG. 3 and FIG. 4 are partial exploded perspective views of a continuous variable valve timing apparatus according to an exemplary embodiment of the present invention.

Figure 5:
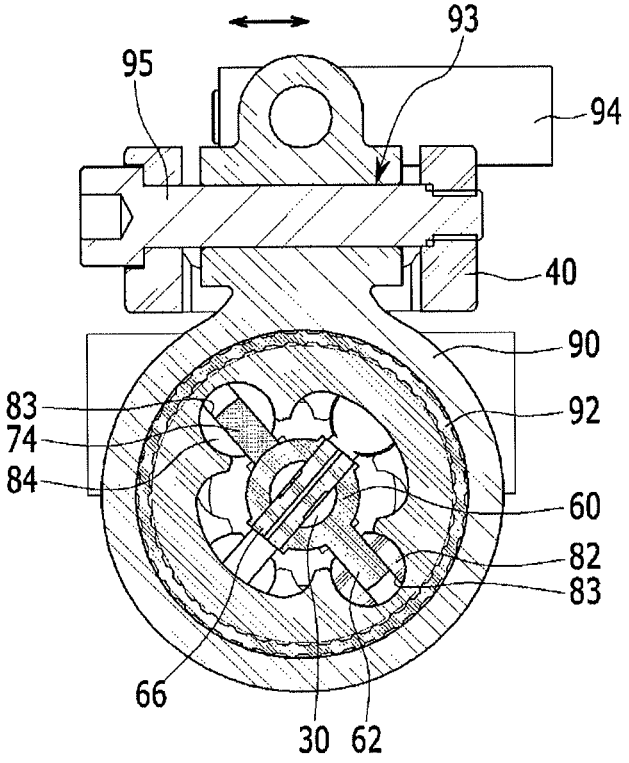
FIG. 5 is a cross-sectional view along a line V-V of FIG. 1.
Figure 6:
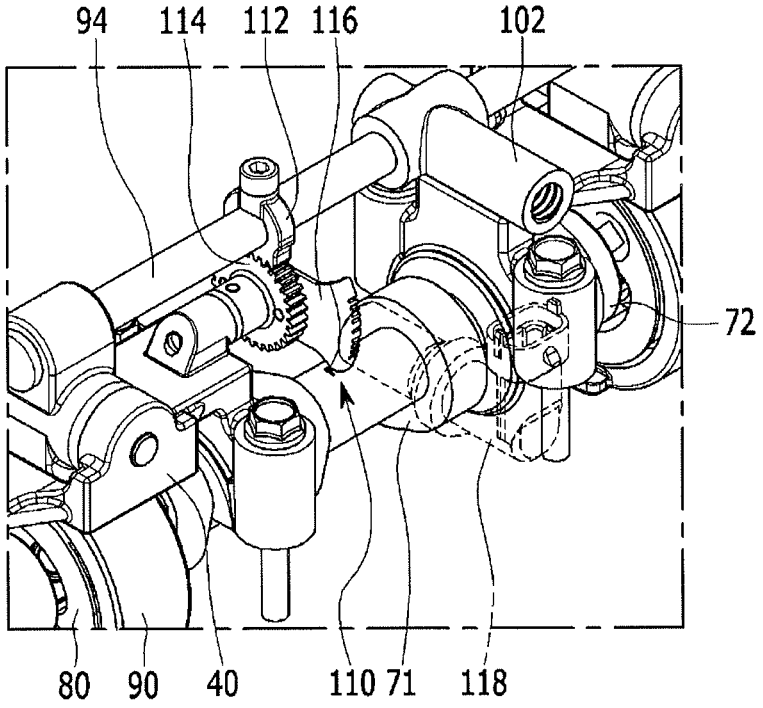
FIG. 6 is a perspective view of a sensor unit applied to a continuous variable valve timing apparatus according to an exemplary embodiment of the present invention.

FIG. 5 is a cross-sectional view along a line V-V of FIG. 1 and FIG. 6 is a perspective view of a sensor unit applied to a continuous variable valve timing apparatus according to an exemplary embodiment of the present invention.

Referring to FIG. 1 to FIG. 6, an engine according to an exemplary embodiment of the present invention includes a cylinder head 10 disposed on the engine block 1 and a continuous variable valve timing apparatus mounted to the cylinder head 10.

The continuously variable valve timing apparatus according to an exemplary embodiment of the present invention includes a camshaft 30, a first and a second cam portions 70*a* and 70*b* of which two cams 71 and 72 are formed thereto, of which the camshaft 30 is inserted thereinto and of which relative phase angles with respect to the camshaft 30 are variable, a first and a second inner brackets 80*a* and 80*b* transmitting rotation of the camshaft 30 to the first and second cam portions 70*a* and 70*b* respectively, a first and a second slider housings 90*a* and 90*b* of which the first and second inner brackets 80*a* and 80*b* are rotatably inserted thereinto respectively and of which relative positions with respect to the camshaft 30 are variable, a control shaft 94 connected with the slider housings 90*a* and 90*b* and a control portion 100 connected with the control shaft 94 and selectively changing the positions of the inner brackets 90*a* and 90*b*.

The camshaft 30 may be an intake camshaft or an exhaust camshaft.

In the drawing, the cam 71 and 72, for driving valves 200, is formed as a pair, but it is not limited thereto.

The engine includes a plurality of cylinders 201, 202, 203 and 204, and the plurality of wheels 60 and the plurality of the cam portions are disposed corresponding to the each cylinder 201, 202, 203 and 204 respectively.

In the drawing, 4 cylinders are formed to the engine, but it is not limited thereto.

A cam cap connecting portion 76 is formed between the two cams 71 and 752 of the cam portions 70*a* and 70*b*, a cam cap 40 is connected with the cylinder head 10 and the cam cap connecting portion 76 is rotatably disposed between the cam cap 40 and the cylinder head 10.

The cam 71 and 72 rotate and open the valve 200.

A rotation ring 60 of which a ring key 62 transmitting the rotation to the first cam portion 70*a* and the second cam portion 70*b* is formed respectively, is mounted to the camshaft 30 and a cam key 74 is formed to the first and second cam portions 70*a* and 70*b* respectively, and the rotation of the rotation ring 60 is transmitted to the first and second cam portions 70*a* and 70*b* through the first and second inner brackets 80*a* and 80*b* respectively.

The continuously variable valve timing apparatus may further include first pins 82 of which a ring key slot 81, the each ring key 62 is slidably inserted thereto, is formed thereto respectively and second pins 84 of which a cam key slot 83, the each cam key 74 is slidably inserted thereto, is formed thereto respectively, and a first sliding pin hole 86 and a second sliding pin hole 88, of which the first pin 82 and the second pin 84 are inserted thereto respectively, are formed to the inner brackets 80*a* and 80*b*.

A camshaft hole 32 and a rotation ring hole 64 is formed to the camshaft 30 and the rotation ring 62 respectively, and a connecting pint 66 is inserted into the camshaft hole 32 and the rotation ring hole 64 for the camshaft 30 to be connected with the rotation ring 62.

The first pin 82 and the second pin 84 are formed as a circular cylinder shape and the first sliding pin hole 86 and the second sliding pin hole 88 are formed for the first pin 82 and the second pin 84 to be rotated within thereto. Since the first pin 82, the second pin 84, the first sliding pin hole 86 and the second sliding pin hole 88 are formed as a circular cylinder, thus wear resistance may be enhanced.

Also, productivity may be increased due to simple shapes of the first pin 82, the second pin 84, the first sliding pin hole 86 and the second sliding pin hole 88.

Parts of the first sliding pin hole 86 and the second sliding pin hole 88 are opened for movements of the ring key 62 and the cam key 74 not to be interrupted.

A bearing 92 is inserted between the slider housing 90 and the inner bracket 80. Thus, rotation of the inner bracket 80 may be easily performed.

In the drawings, the bearing 92 is depicted as a needle bearing, however it is not limited thereto. On the contrary, various bearings such as a ball bearing, a roller bearing and so on may be applied thereto.

A guide hole 93 is formed to the each slider housing 90*a* and 90*b*, and wherein a guide rod 95 inserted into the guide hole 93 is connected with the cam cap 40 in order to guide movements of the slider housings 90*a* and 90*b*.

The control portion 100 includes a ball screw housing 102 connected with the control shaft 94, a ball screw 104 engaged with the ball screw housing 102 and a control motor 106 selectively rotating the ball screw 104.

As shown in FIG. 4, two first and two second cam portions 70*a* and 70*b* are sequentially disposed, two ring keys 62 are formed to the rotation ring 60, and rotation of one rotation ring 60 is transmitted to the first and the second cam portions 70*a* and 70*b* simultaneously.

For example, an engine with a first, second, third and fourth cylinders 211, 212, 213 and 214 may be provided with two rotation rings 60, two first and second cam portions 70*a* and 70*b*, two inner brackets 80*a* and 80*b*, two slider housings 90*a* and 90*b* and one control motor 106 and perform changing timing of each cam 71 and 72. Thus, the continuously variable valve timing apparatus according to an exemplary embodiment of the present invention may reduce numbers of elements, thus durability may be improved and operation stability may be obtained.

The continuously variable valve timing apparatus may further include a sensor unit 110 detecting movements of the slider housings 90.

The sensor unit 110 include a rack gear 112 mounted to the control shaft 94, a spur gear 114 rotatably mounted to the slider housings 90*a* and 90*b* and engaged with the rack gear 114, a sensor plate 116 mounted to the spur gear 114 and a sensor 118 detecting rotation of the sensor plate 116.

When the control shaft 94 moves according to rotation of the control motor 106, the spur gear 114 rotatably mounted to the slider housings 90*a* and 90*b* and the sensor plate 116 rotates, the sensor 118 detects rotation of the sensor plate 116 and measures movements of the slider housings 90*a* and 90*b*.

Figure 7:
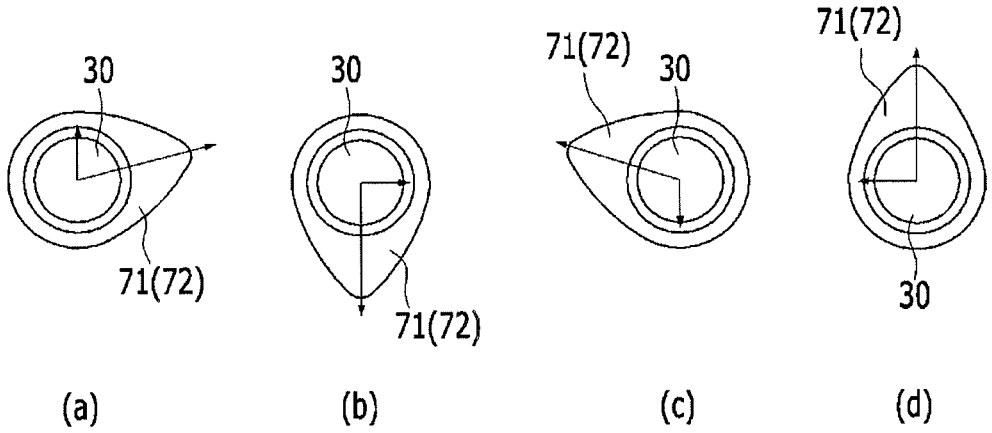
FIG. 7 and FIG. 8 are drawings showing mechanical motions of cams of a continuous variable valve timing apparatus according to an exemplary embodiment of the present invention.
Figure 8:
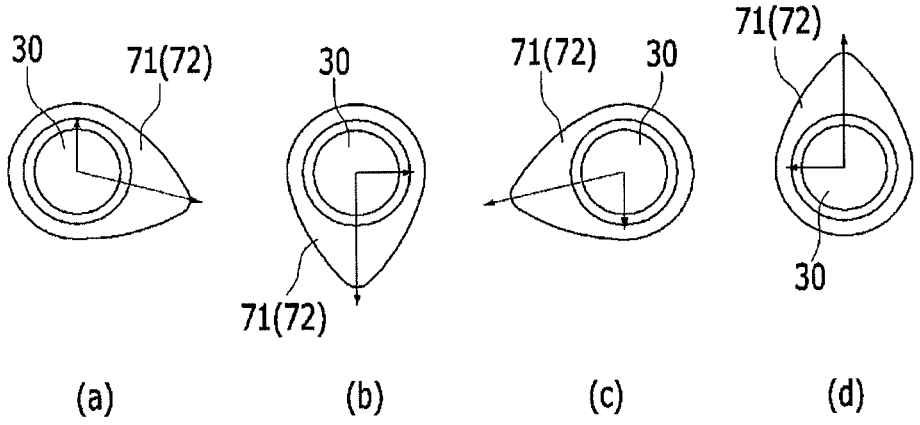

FIG. 7 and FIG. 8 are drawings showing mechanical motions of cams of a continuous variable valve timing apparatus according to an exemplary embodiment of the present invention.

According to engine operation states, an ECU (engine control unit or electric control unit) transmits control signals to the motor 108 of the control portion 100 to change a relative position of the slider housing 90.

In an exemplary embodiment of the present invention, the slider housing 90 moves left or right direction with respect to rotation center of the camshaft 30.

When the slider housing 90 moves to one direction with respect to the rotation center of the camshaft 30, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a as shown in FIG. 7.

When the slider housing 90 moves to opposite direction with respect to the rotation center of the camshaft 30, the rotation speed of the cams 71 and 72 is relatively slower than rotation speed of the camshaft 30 from phase a to phase b and from phase b to phase c, then the rotation speed of the cams 71 and 82 is relatively faster than rotation speed of the camshaft 30 from phase c to phase d and from phase d to phase a as shown in FIG. 8.

While rotation ring is rotated together with the camshaft 30, the ring key 62 is slidable within the ring key slot 81, the first pin 82 and the second pin 84 are rotatable within the first sliding pin hole 86 and the second sliding pin hole 88 respectively and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

Figure 9:
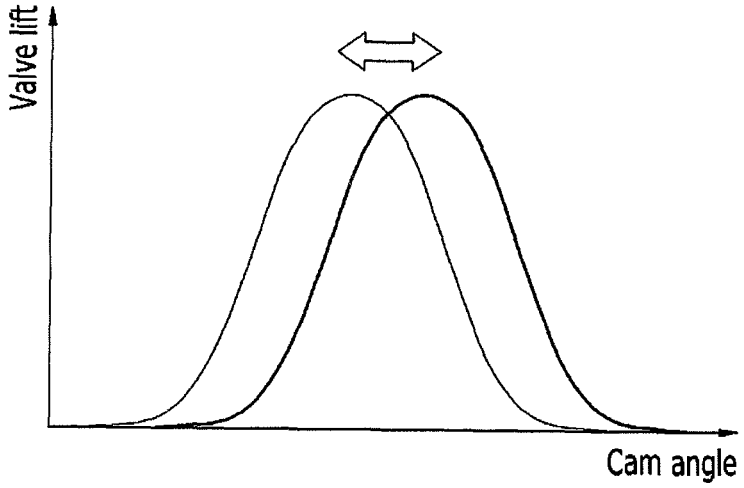
FIG. 9 is a graph of a valve profile of a continuous variable valve timing apparatus according to an exemplary embodiment of the present invention.

FIG. 9 is a graph of a valve profile of a continuous variable valve timing apparatus according to an exemplary embodiment of the present invention.

As shown in FIG. 9, although maximum lift of the valve 200 is constant, however rotation speed of the cam 71 and 72 with respect to the rotation speed of the camshaft 30 is changed according to relative positions of the slider housing 90 so that valve timing is changed and various valve profile or valve timing may be performed.

As an example shown in FIG. 9, duration of the valve 200 is constant and opening and closing time of the valve 200 is uniformly controlled, however, it is not limited thereto. According to mounting angle of the valve 200 and so on, various valve timing may be performed. That is, according to adjusting contacting positions of the cam 71 and 72 and the valve 200, the valve 200 closing timing may be constant, opening timing and closing timing of the valve 200 may simultaneously be changed or may be operated as a variable valve duration apparatus.

As described above, a continuous variable valve timing apparatus according to an exemplary embodiment of the present invention may vary valve timing according to operation conditions of an engine, with a simple construction.

The continuous variable valve timing apparatus according to an exemplary embodiment of the present invention may be reduced in size and thus the entire height of a valve train may be reduced.

Since the continuous variable valve timing apparatus may be applied to an existing engine without excessive modification, thus productivity may be enhance and production cost may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve timing apparatus comprising:

a camshaft;

a first cam portion and a second cam portion of which two cams are formed thereto, of which the camshaft is inserted thereinto;

a first inner bracket and a second inner bracket transmitting rotation of the camshaft to the first cam portion and the second cam portion respectively;

a first slider housing and a second slider housing of which the first inner bracket and the second inner bracket are rotatably inserted thereinto respectively;

a control shaft connected with the first and second slider housings; and a control portion connected with the control shaft and configured for selectively changing positions of the first and second inner brackets.

2. The continuously variable valve timing apparatus of claim 1, further comprising a rotation ring mounted to the camshaft and of which a ring key transmitting the rotation of the camshaft to the first cam portion and the second cam portion is formed respectively, wherein a cam key is formed to the first and second cam portions respectively, and a rotation of the rotation ring is transmitted to the first and second cam portions through the first and second inner brackets respectively.

3. The continuously variable valve timing apparatus of claim 2, further comprising:

first pins of which a ring key slot, each ring key is slidably inserted thereto, is formed thereto respectively; and second pins of which a cam key slot, each cam key is slidably inserted thereto, is formed thereto respectively, and wherein a first sliding pin hole and a second sliding pin hole, of which the first pin and the second pin are inserted thereto respectively, are formed to the first and second inner brackets.

4. The continuously variable valve timing apparatus of claim 3, wherein the first pin and the second pin are formed as a circular cylinder shape; and the first sliding pin hole and the second sliding pin hole are formed for the first pin and the second pin to be rotated within thereto.

5. The continuously variable valve timing apparatus of claim 4, wherein parts of the first sliding pin hole and the second sliding pin hole are opened for movements of the each ring key and the each cam key not to be interrupted.

6. The continuously variable valve timing apparatus of claim 1, further comprising a bearing inserted between the first and second slider housings and the first and the second inner brackets.

7. The continuously variable valve timing apparatus of claim 1, wherein a cam cap connecting portion is formed between the two cams of the cam portions, wherein a cam cap is connected with a cylinder head, and wherein the cam cap connecting portion is rotatably disposed between the cam cap and the cylinder head.

8. The continuously variable valve timing apparatus of claim 7, wherein a guide hole is formed to each of the first and second slider housings, and wherein a guide rod inserted into the guide hole is connected with the cam cap to guide movements of the first and second slider housings.

9. The continuously variable valve timing apparatus of claim 1, wherein the control portion comprises:

a ball screw housing connected with the control shaft;

a ball screw engaged with the ball screw housing; and a control motor selectively rotating the ball screw.

10. The continuously variable valve timing apparatus of claim 1, further comprising a sensor unit detecting movements of the first and second slider housings.

11. The continuously variable valve timing apparatus of claim 10, wherein the sensor unit comprises:

a rack gear mounted to the control shaft;

a spur gear rotatably mounted to the first and second slider housings and engaged with the rack gear;

a sensor plate mounted to the spur gear; and a sensor detecting rotation of the sensor plate.

12. An engine comprising:

a camshaft;

two first and second cam portions of which two cams are formed thereto respectively, of which the camshaft is inserted thereinto;

a rotation ring mounted to the camshaft and of which two ring keys are formed thereto;

a first inner bracket and a second inner bracket transmitting rotation of the two ring keys to the first and second cam portions respectively;

a first slider housing and a second slider housing of which the first and second inner brackets are rotatably inserted thereinto respectively;

a control shaft connected with the first and second slider housings; and a control portion connected with the control shaft and configured for selectively changing positions of the first and second inner brackets.

13. The engine of claim 12, wherein the control portion comprises:

a ball screw housing connected with the control shaft;

a ball screw engaged with the ball screw housing; and a control motor selectively rotating the ball screw.

14. The engine of claim 12, further comprising:

first pins of which a ring key slot, each ring key is slidably inserted thereto, is formed thereto respectively; and second pins of which a cam key slot, each cam key is slidably inserted thereto, is formed thereto respectively, and wherein a first sliding pin hole and a second sliding pin hole, of which the first pin and the second pin are inserted thereto respectively, are formed to the first and second inner brackets.

15. The engine of claim 12, further comprising a bearing inserted between the first and second slider housings and the first and the second inner brackets.

16. The engine of claim 12, wherein a cam cap connecting portion is formed between the two cams of the cam portions, wherein a cam cap is connected with a cylinder head, and wherein the cam cap connecting portion is rotatably disposed between the cam cap and the cylinder head.

17. The engine of claim 12, wherein a guide hole is formed to each slider housing of the first and second slider housings, and wherein a guide rod inserted into the guide hole is connected with the cam cap to guide movements of the first and second slider housings.

18. The engine of claim 12, further comprising:

a rack gear mounted to the control shaft;

a spur gear rotatably mounted to the first and second slider housings and engaged with the rack gear;

a sensor plate mounted to the spur gear; and a sensor detecting rotation of the sensor plate.

* * * * *